US009161589B2

(12) United States Patent
Parisotto et al.

(10) Patent No.: US 9,161,589 B2
(45) Date of Patent: Oct. 20, 2015

(54) SKI BOOT

(75) Inventors: Davide Parisotto, Casella D'Asolo (IT); Luca Gasparini, Livigno (IT)

(73) Assignee: Calzaturificio S.C.A.R.P.A. S.P.A., Asolo (IT)

( * ) Notice: Subject to any disclaimer, the term of this patent is extended or adjusted under 35 U.S.C. 154(b) by 561 days.

(21) Appl. No.: 13/415,884

(22) Filed: Mar. 9, 2012

(65) Prior Publication Data

US 2012/0227286 A1 Sep. 13, 2012

(30) Foreign Application Priority Data

Mar. 9, 2011 (IT) ..... TV2011A0035

(51) Int. Cl.

| | |
|---|---|
| ***A43B 5/04*** | (2006.01) |
| ***A43B 5/00*** | (2006.01) |
| ***A63C 9/08*** | (2012.01) |
| ***A63C 9/086*** | (2012.01) |
| *A63C 9/00* | (2012.01) |

(52) U.S. Cl.

CPC ..... *A43B 5/0494* (2013.01); *A63C 9/086* (2013.01); *A63C 9/0807* (2013.01); *A43B 5/04* (2013.01); *A63C 9/006* (2013.01); *A63C 2201/06* (2013.01)

(58) Field of Classification Search

CPC .. A43B 5/0492; A43B 5/0494; A43B 5/0496; A43B 5/04; A43B 5/0401; A43B 5/0403; A43B 5/04; A43B 5/0413; A43B 5/0415; A43B 5/0417–5/0423; A63C 9/086; A63C 9/0807; A63C 9/006; A63C 2201/06

USPC ..... 36/117.1, 117.2, 117.3, 117.4, 115, 36/118.2

See application file for complete search history.

(56) References Cited

U.S. PATENT DOCUMENTS

| | | | | | |
|---|---|---|---|---|---|
| 3,466,056 | A | | 9/1969 | Heyerdahl | |
| 3,758,965 | A | * | 9/1973 | Caberlotto | 36/117.3 |
| 3,824,713 | A | * | 7/1974 | Vaccari | 36/118.2 |
| 3,826,022 | A | * | 7/1974 | Grzech | 36/117.3 |
| 3,874,684 | A | | 4/1975 | Dysthe | |
| 4,129,319 | A | * | 12/1978 | Strohmeier | 280/615 |
| 5,394,627 | A | * | 3/1995 | Eugler | 36/117.3 |
| 6,065,228 | A | * | 5/2000 | Begey et al. | 36/15 |

(Continued)

FOREIGN PATENT DOCUMENTS

| | | |
|---|---|---|
| DE | 744348 | 1/1944 |
| EP | 1 473 066 A2 | 3/2004 |
| EP | 1 913 828 A1 | 4/2008 |

OTHER PUBLICATIONS

Italian Search Report for IT TV20110035, dated Sep. 30, 2011.

*Primary Examiner* — Jila M Mohandesi

(74) *Attorney, Agent, or Firm* — Raymond Van Dyke; Van Dyke Law

(57) ABSTRACT

Ski-boot includes a rigid shell shaped to accommodate the foot, and a rigid cuff which is shaped to surround the ankle and is hinged on the shell so to be rotatable about a transversal reference axis; the shell being provided with a front sole and with a substantially duckbill-shaped front appendix which protrudes from the tip of the shell to form an extension of the front sole, and is structured so as to engaged in the front jaw of a specific ski fastening device; the front appendix having, on each lateral side, a respective side groove which starts on the appendix upper face at a distance from the appendix tip ranging between 10 and 20 millimeters, and continues by flanking the shell tip while increasing its depth, so to form a descending slope above which a corresponding prong of the front jaw of the ski fastening device is arranged.

16 Claims, 3 Drawing Sheets

(56) References Cited

U.S. PATENT DOCUMENTS

| | | | | |
|---|---|---|---|---|
| 6,247,252 | B1 * | 6/2001 | Parisotto | 36/118.7 |
| 6,409,204 | B1 * | 6/2002 | Ayliffe | 280/613 |
| 7,444,769 | B2 * | 11/2008 | Hall et al. | 36/117.1 |
| 7,810,258 | B2 * | 10/2010 | Narajowski et al. | 36/117.2 |
| 7,931,292 | B2 * | 4/2011 | Miralles | 280/615 |
| 2003/0047912 | A1 | 3/2003 | Hauglin | |
| 2008/0104864 | A1 * | 5/2008 | Hall et al. | 36/117.1 |
| 2009/0113763 | A1 * | 5/2009 | Narajowski et al. | 36/117.3 |
| 2009/0255149 | A1 * | 10/2009 | Rigat | 36/117.3 |
| 2009/0277046 | A1 * | 11/2009 | Sartor et al. | 36/118.7 |

* cited by examiner

SKI BOOT

The present invention relates to a ski boot.

More in detail, the present invention relates to an alpine or Telemark ski boot, use to which the following description refers purely by way of example without this implying any loss of generality.

BACKGROUND OF THE INVENTION

As is known, more recent alpine or Telemark ski boots are made up of a rigid shell made of plastic material and which is shaped so as to accommodate the foot of the user, and is inferiorly provided with a front sole and with a rear heal usually made of non-slip elastomeric material; of a rigid cuff made of plastic material and which is C-shaped so as to surround the ankle of the user from behind, and is hinged to the upper part of the shell so as to rotate about a transversal reference axis substantially coinciding with the articulation axis of the ankle; of an inner liner made of soft and thermal insulating material and which is removably inserted into shell and cuff, and is shaped so as to surround and protect both the foot and the lower part of the leg of the user; and of a protective upper tongue made of plastic material, which has its lower end hinged to the shell, immediately above the tarsal-phalangeal area of the foot, and extends along the upper part of the shell up to beneath the cuff, so as to cover the longitudinal slit of the shell which allows the shell to be temporarily widened in order to facilitate the insertion of the foot into the liner.

The rigid shell of alpine and Telemark ski boots is also frontally provided with a substantially duckbill-shaped, protruding appendix, which protrudes from the ogival tip of the shell while remaining locally substantially coplanar to the front sole, and is structured so as to be firmly and stably coupled, though easily releasable manner, to the toepiece of the ski fastening device which in turn is firmly attached on the middle part of the downhill ski.

In the practice of Telemark skiing, it is also essential to be able to significantly lift the heal of the ski boot from the ski below, while always keeping the tip of the boot firmly anchored to the ski, whereby the front part of the shell of Telemark ski boots is provided at the top with a programmed-deformation gusseted folding which straddles the metatarsal area of the foot, so as to allow the front part of the shell to bend forwards with respect to the tip, so as to go along with the natural movement of the skier's foot.

The ski fastening device is structured instead so as to go along with both the deformations of the shell as a result of the bending of the skier's foot, and with the cyclical lifting of the boot heal from the ski below, thus always and in any event keeping the tip of the boot, or better the duckbill-shaped appendix of the shell, firmly anchored to the ski.

More in detail, the toepiece of the most recent ski fastening devices is structured so as to fix the boot above the ski, tightening the shell at the front sole or solely at the duckbill-shaped protruding appendix, thus allowing the shell to rotate, with respect to the ski beneath, about a horizontal reference axis which is arranged immediately close to the duckbill-shaped protruding appendix and is locally perpendicular to the center line plane of the boot and to the center line plane of the ski.

Unfortunately, recent studies on the kinematics of the movement of the alpine and Telemark ski boot on the ski have shown that, during the initial part of the lifting movement of the boot heal from the ski, the ski fastening devices are not able to transfer the push of the skier to the ski beneath, thus resulting in a part of the skier's movement not implying a forward push.

SUMMARY OF THE INVENTION

Aim of the present invention is to improve the kinematic interaction between the alpine or Telemark ski boot and the ski fastening device so as to increase the performance of the skier without however significantly increasing the cost of ski bindings and Telemark ski boots.

In compliance with these aims, according to the present invention there is provided a ski boot as defined in claim 1 and preferably, though not necessarily, in any one of the dependent claims.

BRIEF DESCRIPTION OF THE DRAWINGS

The present invention will now be described with reference to the accompanying drawings, which show a non-limiting embodiment thereof, in which.

DETAILED DESCRIPTION OF THE INVENTION

Figure 1:
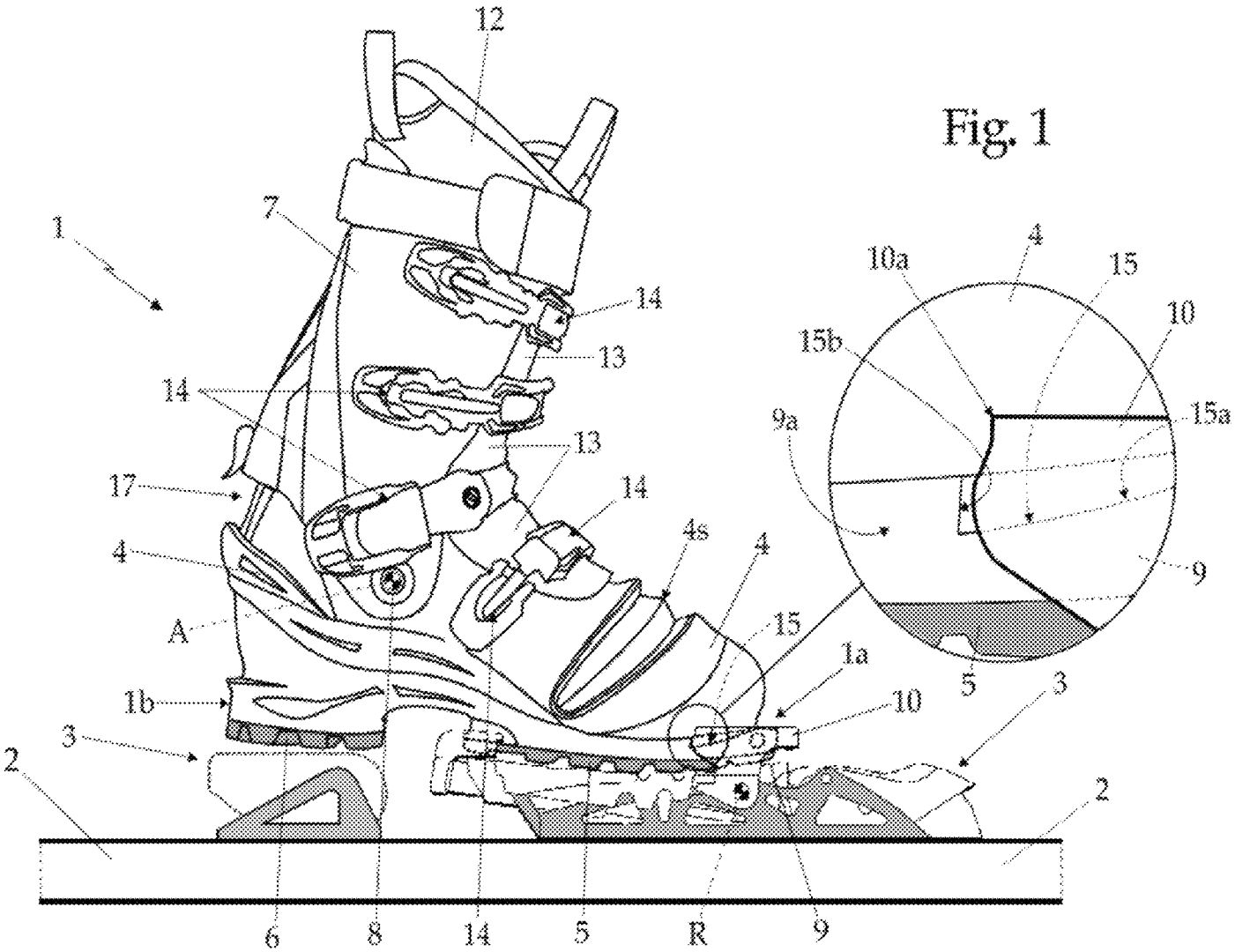
FIG. 1 shows the middle segment of a downhill ski with on top a Telemark ski boot realized according to the teachings of the present invention.
Figure 2:
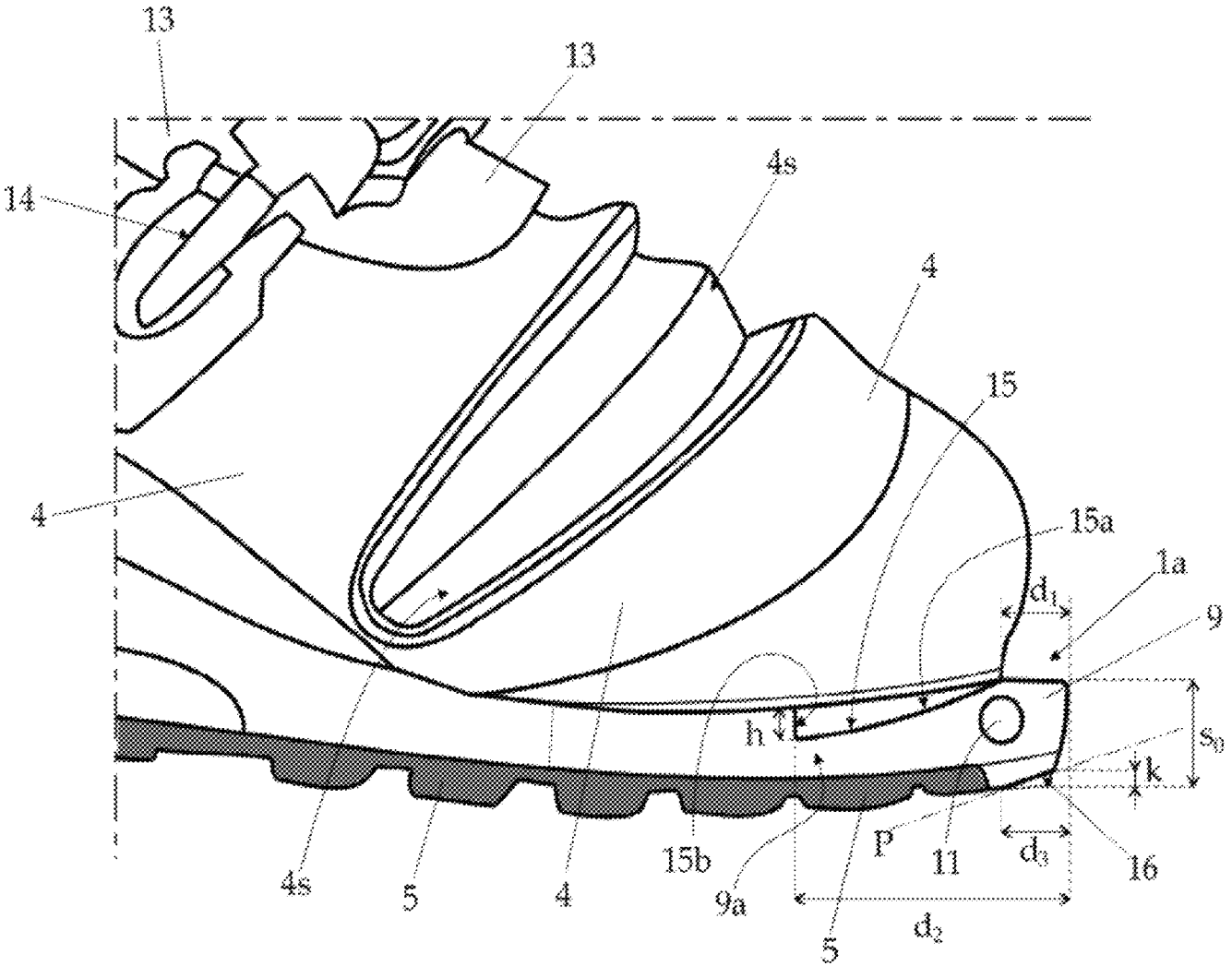
FIG. 2 is a side view of the front part of the Telemark ski boot shown in FIG. 1.

With reference to FIGS. 1 and 2, reference number 1 indicates as a whole a ski boot, and in particular a ski boot specifically structured to do alpine or Telemark skiing.

Boot 1 is adapted to be fastened in known manner on a general alpine or downhill ski 2, by means of a ski fastening device 3 which is firmly attached on the middle segment of ski 2, immediately below the boot 1, and is structured so as to firmly fix the tip 1*a* of boot 1 to the body of ski 2, thus allowing, when needed, the rear part 1*b* of boot 1 to lift from ski 2 following an elastic deformation of the front part of boot 1 and/or following a rotation of boot 1 about a reference axis R, which is arranged immediately close to tip 1*a* of boot 1 and is horizontally oriented so to be locally substantially perpendicular to the center line plane of the boot and to the center line plane of the ski.

The ski fastening device 3, traditionally called ski binding, is a component which is already widely known in the field, and hence won't be further described other than to clarify that one of the most common models of the alpine and Telemark ski fastening device is shown and disclosed in European Patent EP-1790396.

In particular, in the example shown, the ski boot 1 is particularly suitable for being fastened on the back of ski 2 by means of model NTN ski bindings manufactured by Norwegian company ROTTEFELLA AS.

With reference to FIG. 1, boot 1 essentially comprises: an outer rigid shell 4 made of plastic or composite material and which is shaped so as to accommodate the foot of the user, and is inferiorly provided with a front sole 5 and a rear heal 6 both preferably, though not necessarily, made of non-slip elastomeric material; of a rigid cuff 7 made of plastic or composite material and which is substantially C-shaped so as to surround the ankle of the user from behind, and is hinged to the upper part of shell 4 so as to freely oscillate about a transversal reference axis A, which is substantially perpendicular to the center line plane of the boot (i.e. perpendicular to the sheet plane in FIG. 1), and also locally substantially coinciding with the articulation axis of the ankle of the user.

More in detail, cuff 7 is freely pivotally fixed on shell 4 by means of two connecting hinges 8, which are located on the outer and inner sides of shell 4 and of cuff 7, aligned along axis A so as to allow the cuff 7 to freely oscillate/rotate on shell 2, while always remaining locally substantially coplanar to the center line plane of the boot.

Figure 3:
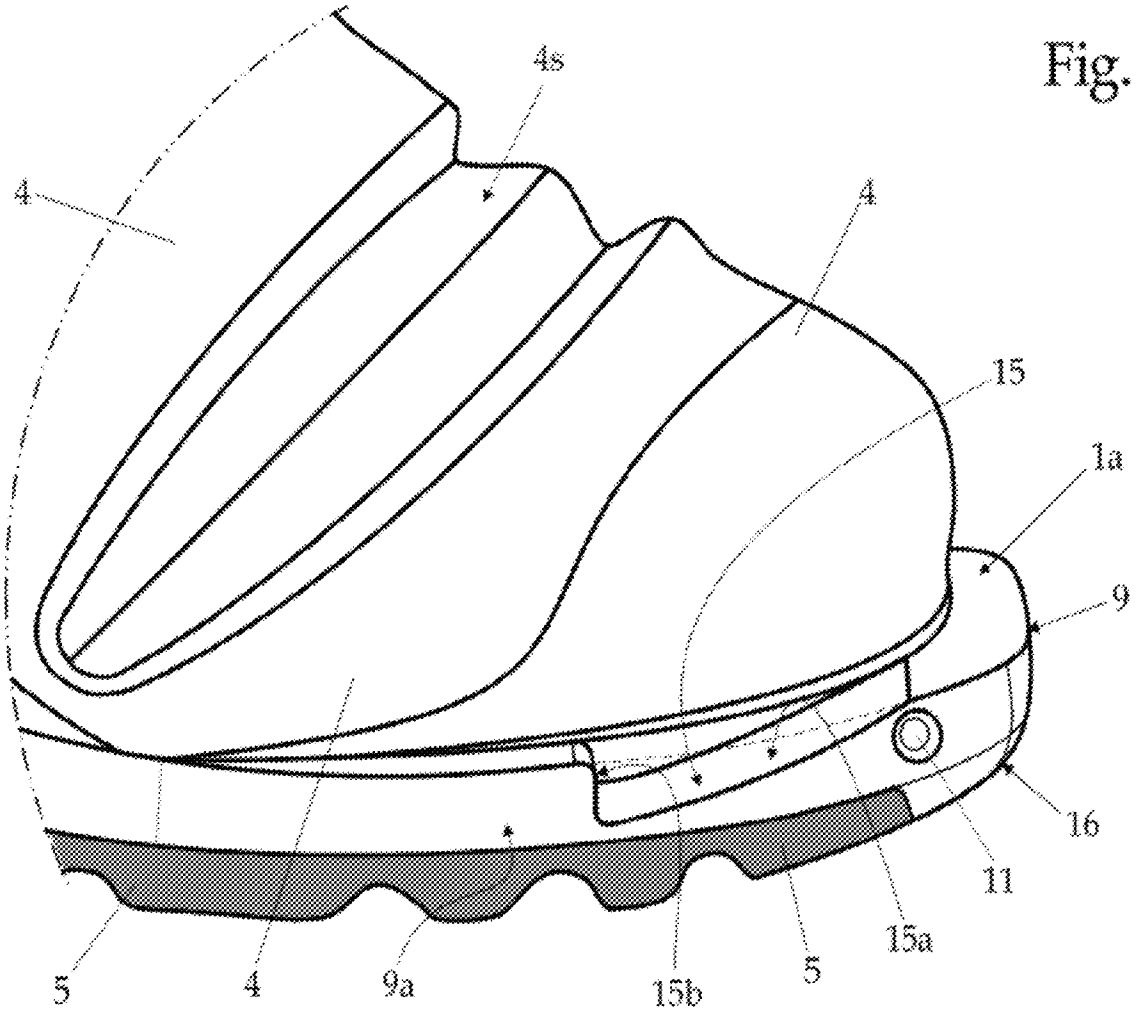
FIG. 3 is a perspective view of the front part of the boot shown in FIG. 2.

With reference to FIGS. 1, 2 and 3, shell 4 is also provided with a substantially duckbill-shaped, front protruding appendix 9, which protrudes from the ogival tip of shell 4 while remaining locally substantially coplanar to the front sole 5, and is structured so as to be coupled/engaged in the substantially horseshoe-shaped front jaw 10 of the toepiece of the ski fastening device 3.

More in detail, the front protruding appendix 9 protrudes from the tip of shell 4 so as to form an extension of sole 5 which is below shell 4, and is preferably made in a single piece with the rest of shell 4 during the injection moulding process of the latter.

Preferably, though not necessarily, shell 4 is also provided with a transversal stiffening bar 11 made of metal material and which extends coaxial to a reference axis which is locally substantially perpendicular to the center line plane of the boot. This bar is also embedded within the protruding appendix 9 of shell 4 so that the two axial ends of the bar come out of the protruding appendix 9, at the two lateral sides 9*a* of the same appendix.

The upper part of shell 4 is instead preferably, though not necessarily, provided with a programmed-deformation gusseted folding 4*s* which extends from one side of shell 4 to the other, straddling the metatarsal area of the foot, and is structured so as to allow shell 4 to bend in the metatarsal area of the foot in order to go along with the natural bending of the foot of the user when skiing.

With reference to FIG. 1, boot 1 also comprises an inner liner 12 which is preferably made of soft and thermal insulating material, is preferably, though not necessarily, accommodated within shell 4 and cuff 7 in a removable manner, and is shaped so as to surround and protect both the foot and the lower part of the leg of the user; and a protective tongue 13 which is positioned on the upper part of shell 4, in the area above the instep and the front part of the leg, to cover the longitudinal slit of the shell (not shown), which is realized at the top ridge of shell 4, i.e. above the instep and in front of the lower part of the tibia, and which allows shell 4 to be temporarily widened in order to facilitate the insertion of the foot into liner 12.

In particular, in the example shown, the protective tongue 13 preferably, though not necessarily, consists of an oblong sheet of plastic or composite material of suitable thickness, which is substantially L-bent, and is arranged to rest on the upper part of shell 4 in the area above the instep and the front part of the leg, so as to cover the longitudinal slit of the shell (not shown).

Finally, boot 1 is provided with a number of manually-operated closing members 14 which are suitably distributed on shell 4 and on cuff 7 to straddle the protective tongue 13, and are structured so as to selectively tighten shell 4 and/or cuff 7 to stably immobilize the leg of the user inside boot 1, or better, liner 12.

With reference to FIGS. 2 and 3, unlike currently known Telemark ski boots, the duckbill-shaped protruding appendix 9 of shell 4 has, on each lateral side 9*a*, a respective side groove 15 that starts on the upper face of the protruding appendix 9 at a distance $d_1$ from the tip of the protruding appendix 9 ranging between 10 and 20 millimeters, i.e. more or less above the corresponding axial end of the transversal bar 11, if any, and then continues towards the joint between protruding appendix 9 and shell 4, progressively increasing its depth so as to form a descending slope 15*a*, i.e. tilted towards the sole 5 beneath, above which a respective prong 10*a* of the front jaw 10 of the ski fastening device 3 is adapted to be arranged.

In other words, the two side grooves 15 are realized on the two lateral sides 9*a* of the protruding appendix 9, in a substantially mirroring position with respect to the center line plane of the boot, so as to form two descending slopes 15*a* which start on the upper face of the protruding appendix 9 at a distance $d_1$ from the tip of the protruding appendix 9 ranging between 10 and 20 millimeters, and then flank the tip of shell 4 while progressively increasing their depth, so that each prong 10*a* of the front jaw 10 of the ski fastening device 3 may be arranged above a respective descending slope 15*a*.

Each side groove 15 is also shaped so that the descending slope 15*a* reaches a nominal depth h ranging between 2 and 5 millimeters, and preferably, though not necessarily, equal to about 3 millimeters, at the terminal end of the corresponding prong 10*a* of the front jaw 10 when the protruding appendix 9 is fitted/engaged in the front jaw 10 of the ski fastening device 3.

More in detail, each side groove 15 is shaped so that the descending slope 15*a* reaches a nominal depth h ranging between 2 and 5 millimeters, and preferably, though not necessarily, equal to about 3 millimeters, at a distance $d_2$ from the tip of the protruding appendix 9 ranging between 40 and 50 millimeters.

In the example shown, in particular, each side groove 15 of protruding appendix 9 is shaped so that the descending slope 15*a* starts at a distance $d_1$ from the tip of the protruding appendix 9 preferably, though not necessarily, equal to about 14 millimeters, and then reaches a nominal depth h preferably, though not necessarily, equal to at least 3 millimeters at a distance $d_2$ from the tip of the protruding appendix 9 preferably, though not necessarily, equal to about 45 millimeters.

With reference to FIG. 2, in the example shown, in particular, each side groove 15 is preferably, though not necessarily, substantially triangular in shape, and ends with a substantially vertical step 15*b* which is located immediately downstream of the terminal end of the corresponding prong 10*a* of the front jaw 10 of the toepiece of the ski fastening device 3, and at a distance $d_2$ from the tip of the protruding appendix 9 ranging between 40 and 50 millimeters and preferably, though not necessarily, equal to about 45 millimeters. Step 15*b* has a nominal height h ranging between 2 and 5 millimeters and preferably, though not necessarily, equal to about 3 millimeters.

With reference to FIGS. 2 and 3, the protruding appendix 9 of shell 4 is also preferably, though not necessarily, provided with a lower flat bevel 16 which extends on a lying plane P locally substantially perpendicular to the center line plane of the boot, and is realized on the lower face of the protruding appendix 9, between the edge of sole 5 and the end of the protruding appendix 9, so as to progressively decrease the thickness of the protruding appendix 9 towards the tip of the same appendix.

In the example shown, in particular, the lower flat bevel 16 starts close to the edge of the front sole 5, at a distance $d_3$ from the tip of the protruding appendix 9 preferably, though not necessarily, equal to distance $d_1$, i.e. immediately below the end of the transversal bar 11 if any, and ends at the tip of the protruding appendix 9, thus causing a progressive reduction k in the local thickness of the protruding appendix 9 ranging between 1 and 3 millimeters.

In particular, in the example shown, the lower flat bevel 16 starts at a distance $d_3$ from the tip of the protruding appendix 9 substantially equal to distance $d_1$, where the nominal thickness $s_0$ of the protruding appendix 9 is equal to about 18 millimeters, and ends at the tip of the protruding appendix 9, thus causing a reduction k in the local thickness of the protruding appendix 9 of about 2 millimeters.

Finally, with reference to FIG. 1, boot 1 is preferably, though not necessarily, also provided with a manually-operated cuff locking device 17, which arranged to straddle shell 4 and cuff 7, in the rear area 1*b* of boot 1 immediately above the heal, and is structured so as to be able to, on choice:

firmly fix cuff 7 to shell 4 so as to prevent any related movement between the two components; or completely release cuff 7 from shell 4 so as to allow cuff 7 to freely oscillate about axis A both forward and backward.

Operation of boot 1 is substantially equal to that of any other currently marketed Telemark ski boot, with the difference that the presence of the side grooves 15, or better of the descending slopes 15*a*, and of the lower flat bevel 16 at the points of contact with the front jaw 10 of the toepiece of the ski fastening device 3, significantly modifies the kinematic interaction between boot 1 and the ski fastening device 3, thus allowing the ski fastening device 3 to also transfer the push from the skier to ski 2 in the initial part of the movement of lifting heal 6 of the boot from the ski 2 below.

The advantages associated with the particular shape of the protruding appendix 9 of shell 4 are noteworthy: a few structural modifications to the protruding appendix 9 of shell 4 allow the ski fastening devices 3 to operate in a more efficient manner, thus significantly improving the performance of the skier during Telemark skiing.

Moreover, the modifications to the structure of the protruding appendix 9 may be realized with a few modifications to the moulds for the injection moulding of shell 4, at particularly low costs.

Finally, the side grooves 15 and the lower flat bevel 16 may also be easily made on the front protruding appendixes of Telemark ski boots already marketed, with all the advantages implied.

Clearly, changes and modifications may be made to the alpine or Telemark ski boot 1 as described herein without, however, departing from the scope of the present invention.

For example, in a different embodiment (not shown), rather than consisting of a sheet of plastic or composite material with semi-rigid structure, the protective tongue 13 may be replaced by a strip of synthetic fabric of suitable thickness, possibly coupled with an impermeable film, which is fixed on the upper part of shell 4, preferably though not necessarily by gluing, in order to cover the longitudinal slit of the shell.

The invention claimed is:

1. A ski boot comprising:

a rigid shell, said rigid shell adapted to accommodate a foot of a user therein;

a rigid cuff, said rigid cuff hinged on said rigid shell adapted to substantially coincide with the articulation axis of the ankle of said user, and rotatable thereabout;

and a front sole and a rear heel sole affixed to a lower portion of said rigid shell, said rigid shell having a protruding portion, said protruding portion extending upon and over said front sole, said protruding portion extending past said front sole, said front sole, said rear heal sole and said protruding portion configured to engage respective ski fasteners secured to a ski, thereby capable of securing said ski boot to said ski, wherein said rigid shell has respective external side grooves along either side of said ski boot, said side grooves beginning a distance from the end of said protruding portion and extending externally along a substantially rearward descending slope therefrom, and wherein said side grooves of said protruding portion are capable of engaging therein a front jaw of a front ski fastener.

2. The ski boot according to claim 1, wherein said distance is between about 10 to about 20 millimeters.

3. The ski boot according to claim 2, wherein said distance is about 14 millimeters.

4. The ski boot according to claim 1, wherein said substantially rearward descending slope of said side grooves reach a depth of from about 2 to about 5 millimeters.

5. The ski boot according to claim 4, wherein said depth is about 3 millimeters.

6. The ski boot according to claim 1, wherein the ends of said side grooves are at a distance from about 40 to about 50 millimeters from the end of said protruding portion.

7. The ski boot according to claim 6, wherein the ends of said side grooves are at a distance from about 45 millimeters from the end of said protruding portion.

8. The ski boot according to claim 6, wherein said substantially rearward descending slope of said side grooves reach a depth of from about 2 to about 5 millimeters.

9. The ski boot according to claim 1, further comprising:

a lower flat bevel, said lower flat bevel being on a lower face of said protruding portion, said lower flat bevel extending between about the front sole and the end of said protruding portion, said lower flat bevel being on a plane substantially perpendicular to a center plane of said ski boot.

10. The ski boot according to claim 9, wherein said lower flat bevel extends from along said lower face of said protruding portion at a start point thereon substantially equal to said distance from the end of said protruding portion.

11. The ski boot according to claim 10, wherein said lower flat bevel creates a reduction in the thickness of the end of said protruding portion, said flat bevel decreasing the nominal thickness of said protruding portion at the end thereof by said reduction, said reduction being between about 1 to about 3 millimeters.

12. The ski boot according to claim 11, wherein said reduction is about 2 millimeters.

13. The ski boot according to claim 1, further comprising:

a stiffening bar, said stiffening bar extending coaxially from one side of said ski boot to the other side through said protruding portion and substantially perpendicular to a center plane of said ski boot.

14. The ski boot according to claim 13, wherein said stiffening bar is made of metal.

15. The ski boot according to claim 13, wherein said side grooves begin at a point substantially above said stiffening bar, and extend rearward therefrom.

16. A ski assembly comprising:

a ski;

a ski boot;

said ski boot comprising a rigid shell, said rigid shell adapted to accommodate a foot of a user therein;

said ski boot comprising a rigid cuff, said rigid cuff hinged on said rigid shell adapted to substantially coincide with the articulation axis of the ankle of said user, and rotatable thereabout;

said ski boot comprising a front sole and a rear heel sole affixed along a lower portion of said rigid shell, said rigid shell of said ski boot having a protruding portion, said protruding portion extending upon and over said front sole, said protruding portion extending past said front sole, at least one ski fastener, said front sole, said rear heal sole and said protruding portion engaging said at least one ski fastener secured to said ski, thereby securing said ski boot to said ski, wherein said rigid shell has respective external side grooves along either side of said ski boot, said side grooves beginning a distance from the end of said protruding portion and extending externally along a substantially rearward descending slope therefrom, and wherein a front jaw of a front ski fastener engages said protruding portion about said side grooves therein.

* * * * *